US005117156A

United States Patent [19]

Leyh et al.

[11] Patent Number: 5,117,156

[45] Date of Patent: May 26, 1992

[54] RAPID START FLUORESCENT LAMP HAVING QUICK HOT RESTARTING

[75] Inventors: Thomas O. Leyh, Bridgeport; Walter A. Boyce, Fairmont, both of W. Va.

[73] Assignee: North American Philips Corp., New York, N.Y.

[21] Appl. No.: 623,138

[22] Filed: Dec. 6, 1990

[51] Int. Cl.[5] ..... H01J 7/44; H01J 13/46

[52] U.S. Cl. ..... 315/73; 315/74; 315/100; 315/DIG. 5; 313/51; 313/623

[58] Field of Search ..... 315/73, 74, 106, 107, 315/119, 104, 49, 50, 51, 100, DIG. 5, 98; 313/623, 49, 51, 493

[56] References Cited

U.S. PATENT DOCUMENTS

| | | | |
|---|---|---|---|
| 2,462,335 | 2/1949 | Reinhardt | 315/100 |
| 4,114,968 | 9/1978 | Latassa | 316/1 |
| 4,510,418 | 4/1985 | Anderson, Jr. et al. | 315/73 |
| 4,517,493 | 5/1985 | Dembowski et al. | 315/73 |
| 4,528,479 | 7/1985 | Bonazoli et al. | 315/73 |
| 4,554,526 | 11/1985 | Bricknell | 337/379 |
| 4,656,396 | 4/1987 | Audesse | 315/73 |
| 4,695,768 | 9/1987 | Covington et al. | 315/73 |
| 4,709,187 | 11/1987 | Roche | 315/74 |
| 4,857,808 | 8/1989 | Lally et al. | 315/100 |

*Primary Examiner*—Eugene R. LaRoche
*Assistant Examiner*—Ali Neyzari
*Attorney, Agent, or Firm*—William L. Botjer

[57] ABSTRACT

A rapid start fluorescent lamp having an improved hot restarting time. The lamp includes the standard envelope and end cap through which electrical connection is made by conductive feedthroughs which extend through the lamp stem to the interior of the lamp. One of the feedthroughs is connected to the cathode, and the other is connected to the leads of a fuse element which is contained within an envelope to isolate the fusible element from the lamp environment. A thermally activated bimetallic element is disposed across the leads of the fuse. The other lead of the fusible element is connected to the other end of the cathode. When the bimetal element is cold, it will bridge the connection between the other feedthrough to the other end of the cathode to permit rapid starting. When the bimetal heats up, the connection of both ends of the cathode to the heating current is broken. The location of the bimetallic element within the lamp envelope but not in the fuse container permits it to open and close more rapidly. Additionally the fuse assembly is utilized as part of the supporting structure for the filament assembly.

5 Claims, 2 Drawing Sheets

RAPID START FLUORESCENT LAMP HAVING QUICK HOT RESTARTING

BACKGROUND OF THE INVENTION

The invention relates to fluorescent lamps of the so-called "rapid start" type. Such lamps and provided with thermal switches, responsive to cathode (filament) heat, for turning off the cathode heating current after starting and during lamp operation.

Rapid start fluorescent lamps are provided with cathode heating current, for heating the cathodes to electron-emitting temperature so that the lamps start quickly without damaging the electron-emitting material of the cathodes. The cathode heating consumes about one and one-half to two watts of electrical power per cathode. While the lamps are operating, the cathodes can provide adequate electron emission without the need for the supply of heating current to the cathodes. Accordingly, turning off the cathode heating current when the lamps are operating can save about three or four watts of electrical energy per lamp, resulting in considerable energy and money savings in lighting systems. In this regard, see U.S. Pat. No. 4,517,493.

U.S. Pat. Nos. 4,097,779 and 4,114,968 disclose rapid start fluorescent lamps provided with a thermal cutout switch near each cathode, and in electrical series with the associated cathode, for turning off the cathode current after the lamps start and while they are operating. These patents disclose U-shaped bimetal switches sealed in glass envelopes which are mounted near each cathode. After each cathode is heated sufficiently by the heating current heat from the cathode causes the nearby bimetal switch member to bend and open the current circuit to the cathode.

The manufacture of fluorescent lamps involves coating the tungsten cathode coils with an electron emission coating. After the lamps are assembled, the cathodes are "activated" by passing current through them to heat them. However, the cathode current cutout switches in the lamps will turn off the activation cathode heating current prior to complete activation of the cathodes. U.S. Pat. No. 4,114,968 solves this problem by connecting fuse wires across the thermal switch, for shorting the switch and permitting activation of the cathodes. The fuses are then "blown" (severed), by applying an electrical pulse through each of the series-connected fuses and cathodes. The fuses must be able to carry the cathode activation current and also be capable of being "blown" by a current pulse of insufficient strength to damage the cathode. Fuse timing is also important, since the fuse-blowing pulse must be applied while the thermal switch is in open condition so it will not short-circuit the pulse away from the fuse.

The quick start designs currently being marketed share a common problem: hot restarting. When the lamps are turned off after the switches have opened, a cool-off period is required to allow the switches to close, thus permitting current to flow through the cathode and restart the lamp. A series of tests were performed on rapid start lamps from various manufacturers to determine the restart time in a worst case scenario. The test consisted of operating the lamps for 20 minutes at an ambient temperature of 110° F., which is the approximate temperature that the lamps experience in a standard four-lamp fixture. The lamps were then shut off for approximately two seconds and turned back on at 108 volts. The time that was required for the lamps to start was recorded. The times recorded for three major lamp manufacturers ranged from 52 to 68 seconds. All of these restart times are longer than would be considered acceptable by the consumer. The present invention is directed toward providing a rapid start lamp having a considerably shorter hot restart time.

SUMMARY OF THE INVENTION

This invention is directed to a rapid start fluorescent lamp having an improved hot restarting time. The lamp includes the standard envelope and end cap through which electrical connection is made by conductive feedthroughs which extend through the lamp stem to the interior of the lamp. One of the feedthroughs is connected to the cathode, the other of is connected to the leads of a fusible element which is contained within an envelope to isolate the fusible element from the lamp environment. A thermally activated bimetallic element is disposed across the leads of the fuse. The other lead of the fusible element is connected to the other end of the cathode. When the bimetal element is cold, it will bridge the connection between the other feedthrough to the other end of the cathode to permit rapid starting by application of heating current. When the bimetal heats up, the connection of both ends of the cathode to the heating current is broken.

In this design, the fusible element is enclosed within a container and is thus isolated from the lamp environment. However, the bimetallic element, since it is not located within the container may be is larger than that of previous lamps. Additionally, the bimetallic element is positioned beneath the upper surface of the glass seal through which the feedthrough wires extend. By placing the bimetallic element in this location, the heat radiated by the arc glow and the heating of the filament prior to lamp starting does not cause premature opening of the switch which could prevent the lamp from starting. This positioning also permits rapid closing of the switch when the lamp is shut off thus permitting quicker hot restarting. Additionally, the cathode mount feedthroughs and fusible element are arranged in an economical manner which utilizes the leads of the fusible element as a supporting structure for the bimetallic switch, thus saving materials and expense, which are important considerations for mass produced lamps.

BRIEF DESCRIPTION OF THE DRAWINGS

For a better understanding of the invention, reference is made to the following drawings which are to be taken in connection with the detailed specification to follow.

DESCRIPTION OF THE PREFERRED EMBODIMENTS

Figure 1:
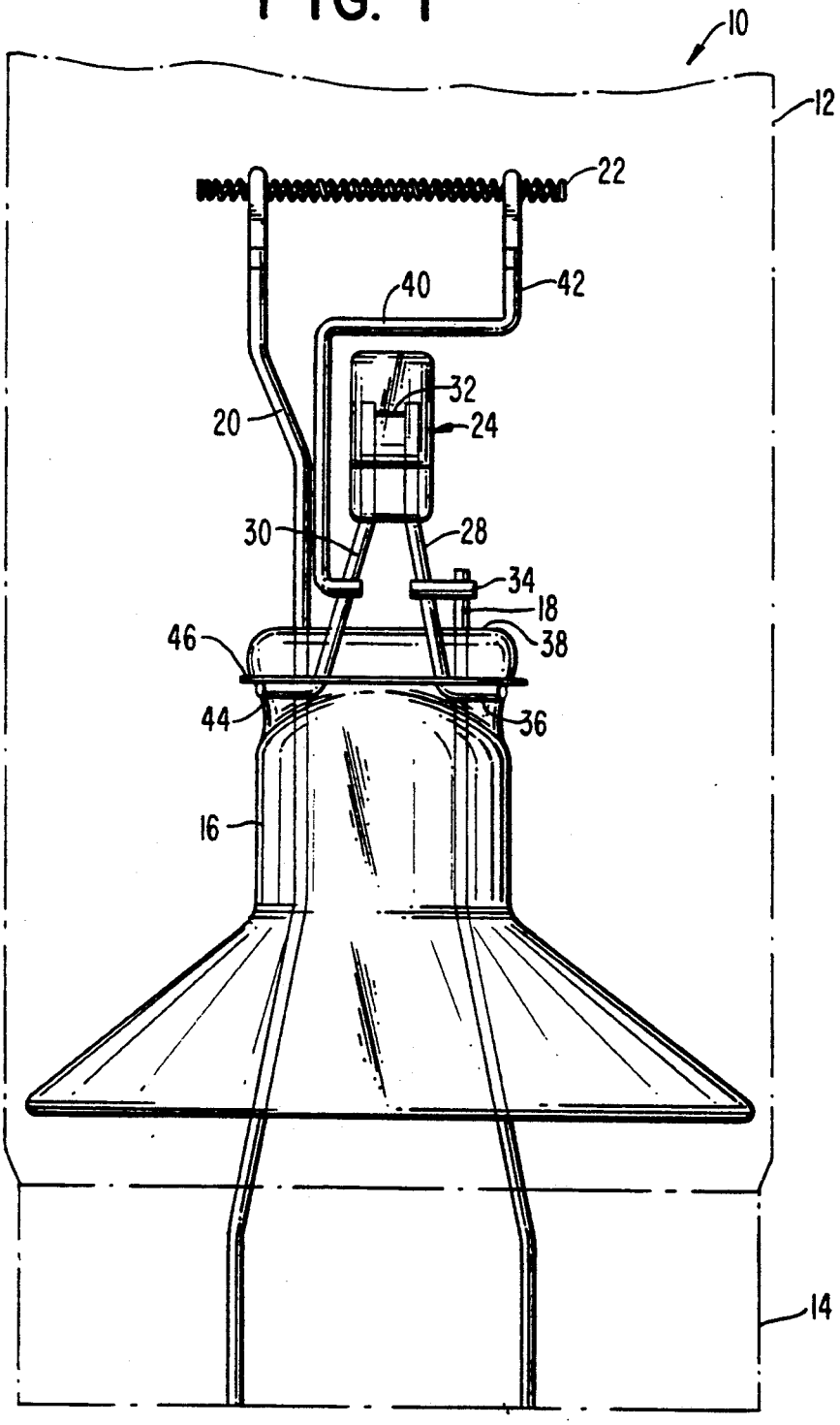
FIG. 1 is a front view of the cathode mount and bimetallic element constructed in accordance with the present invention.
Figure 2:
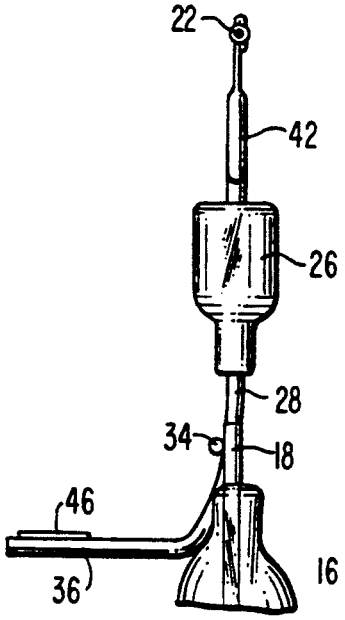
FIGS. 2 and 3 are a side view and a top view of the arrangement of FIG. 1.
Figure 3:
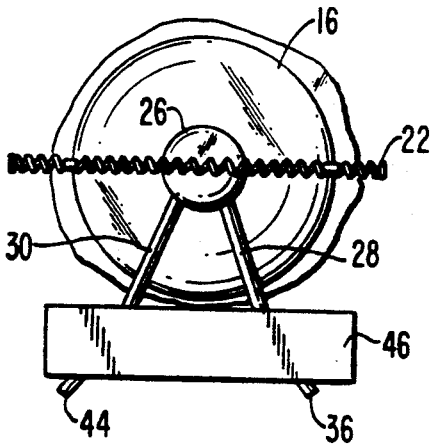

The drawings illustrate a fluorescent lamp 10 which includes a glass envelope 12 and an end cap 14 of any standard design. Envelope 12 is generally constructed of glass and coated internally with a phosphor material and containing a gas fill as is known to those skilled in the art. Extending away from endcap 14 is a glass stem 16 through whose upper surface extend conductive feedthroughs 18, 20 which are connected to electrical connectors on end cap 14 and thereafter to the source of current. Feedthrough 20 provides electrical connection and mechanical support to one end of a cathode 22. The upper surface of stem 16 has been illustrated as flat, however a flat surface is not necessary as it may be of any configuration.

Also mounted within envelope 12 is an enclosed fuse assembly 24 which includes a container 26 and a pair of lead wires 28, 30. Connected internally within container 24 between lead wires 28, 30 is a fusible (frangible) element 32. Fusible element 32 is mounted within container 24 so that it is isolated from the environment of envelope 12 which permits fusible element 32 to be blown after actuation of cathode 22 during lamp manufacture without contaminating the lamp environment. After fusible element 32 is severed it plays no part in the electrical connection of cathode 22. However fuse assembly 24 at all times serves as part of the mechanical support of the cathode and thermal switch.

Lead 28 of fuse 24 is electrically and mechanically joined to feedthrough 18 by means of a connecting wire 34 which extends toward envelope 12. The lower end 36 of lead 28 of fuse 24 extends parallel to but beneath the upper surface 38 of lamp stem 16. Lead 30 of fuse 24 is connected to a wire 40 which leads upwardly and joins a support rod 42 which is connected to the other end of cathode 22. The lower portion 44 of lead 30 of fuse 24 also extends parallel and beneath the upper surface 38 of lamp stem 16.

A bimetallic element 46 extends between portions 36 and 44 of fuse leads 28, 30 so as to provide electrical connection therebetween when it is unheated. One end of bimetallic element 46 is fixed to portion 36 of lead 28 and the other end of bimetallic element 46 contacts portion 44 of lead 30 when unheated. When bimetallic element 46 is heated, the free end will be biased away from contact with portion 44 of lead 30 to break the electrical connection between leads 28 and 30 and thus cut off the supply of heating current to cathode 22.

In operation, upon cold starting, bimetallic element 46 will be in engagement of arm 34 of lead 30. Thus, an electrical connection will be made between feedthrough 18, connecting wire 34, fuse lead 28, bimetallic element 46, fuse lead 30, wire 40, support arm 42, cathode 22 and feedthrough 20. Accordingly, heating current will flow to cathode 22 for starting. After lamp 10 becomes lit, the heat of the lamp operation causes the free end of bimetallic element 46 to be biased away from arm 44 to break the electrical connection between feedthroughs 18 and 20 to cathode 22. Thus, only feedthrough 20 will be connected to cathode 22.

The location of the bimetallic element 46 outside of fuse container 26 and its positioning beneath the upper surface 38 of lamp stem 16 permits a larger than usual bimetallic element 46 to be utilized. Suitable dimensions are on the order of $14.45 \times 3.25 \times 0.15$ millimeters. Suitable material for bimetallic element 46 is 40% nickel and 60% iron on the low expansion side and 75% nickel, 22% iron and 3% chrome on the high expansion side. Of course, the dimensions and composition may be varied depending on the application and desired operational parameters. In the location illustrated, the heat radiated by the arc glow of cathode 22 and its heating prior to starting will not cause premature opening of bimetallic element 46, which would prevent the lamp from starting. Tests indicate that the hot restarting time of a lamp constructed in accordance with the present invention is on the order of 30 seconds which is less than half the time of conventionally designed lamps. Clearly this delay is more acceptable to the consumer.

Although the present invention has been described in conjunction with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A rapid start fluorescent lamp comprising:

a lamp envelope;

an end cap disposed on one end of said lamp envelope;

a lamp stem having an upper surface disposed within said envelope;

first and second conductive feedthroughs extending through the upper surface of said lamp stem to said endcap for electrical connection thereto;

filament means, said filament means being electrically connected to one of said conductive feedthroughs;

thermally activated switch means, said switch means being electrically connected between said first and second feedthroughs when cold and being disconnected from said first and second feedthroughs when heated; and said switch means being positioned within said lamp envelope at a level below that of the upper surface of the lamp stem.

2. The fluorescent lamp as claimed in claim 1 wherein said switch means are disposed so that the plane of the switch means is perpendicular to the longitudinal axis of the lamp envelope.

3. The fluorescent lamp as claimed in claim 1 further including fuse means connected between said first and second feedthrough, said fuse means having a frangible element connected to said feedthroughs.

4. The fluorescent lamp as claimed in claim 3 wherein said fuse means includes a container which seals said fusible element therewithin so as to isolate the frangible element from the environment of the lamp envelope.

5. The fluorescent lamp as claimed in claim 1 wherein said thermally activated switch means comprises a bimetallic element.

* * * * *